US005231903A

United States Patent [19]

Bockman, Jr.

[11] Patent Number: 5,231,903

[45] Date of Patent: Aug. 3, 1993

[54] REVERSIBLE RATCHET WRENCH

[75] Inventor: Harry L. Bockman, Jr., Seal Beach, Calif.

[73] Assignee: Hi-Shear Corporation, Torrance, Calif.

[21] Appl. No.: 883,050

[22] Filed: May 8, 1992

Related U.S. Application Data

[63] Continuation of Ser. No. 631,914, Dec. 20, 1990, abandoned.

[51] Int. Cl.[5] ..... B25B 13/46

[52] U.S. Cl. ..... 81/63.2; 192/43.2; 81/63

[58] Field of Search ..... 81/63-63.2; 192/43.1, 43.2

[56] References Cited

U.S. PATENT DOCUMENTS 2,701,977 2/1955 Stone ..... 81/63.2
2,957,377 10/1960 Hare ..... 81/63.2
3,393,780 7/1968 Kilness ..... 192/43.2

*Primary Examiner*—James G. Smith
*Attorney, Agent, or Firm*—Donald D. Mon

[57] ABSTRACT

A ratchet wrench with unitary floating pawl. The pawl has arcuate sides which rest against arcuate walls in the wrench body permitting rotation of the pawl in the body when a detented flat reaction bar slidably contained in the wrench body is positioned against one of two projecting pads on the pawl. The contacted projecting pad on the pawl restrains the pawl from rotation in one direction and the clearance of the second pad with the reaction ar permits the pawl to ratchet in the other direction. Sliding the detented reaction bar changes the direction of wrenching and ratcheting. An efficient, strong, thin-walled body for effective use in close quarters is the result.

5 Claims, 1 Drawing Sheet

REVERSIBLE RATCHET WRENCH

CROSS-REFERENCE TO OTHER PATENT APPLICATION

This is a continuation of applicant's presently-pending U.S. patent application Ser. No. 07/631,914, filed Dec. 20, 1990, which will be abandoned after this application is fully filed.

BACKGROUND OF THE INVENTION

This invention relates to a ratchet wrench having a unitary floating ratchet pawl contained within the body of the wrench for a slidable rotation within the wrench body.

Ratchet wrenches generally have a small pawl pivoted to the body of the wrench for engagement with the ratchet wheel for rotation of the wrenching portion. The pawl must be of a dual nature, often two separate parts, to reverse the rotation of the ratchet wheel. Shifting of pawl engagement must be done by an external wheel or level acting upon the pawl mechanism. This assembly of pawls produces excess size for the body of the wrench.

An object of this invention is to provide a unitary pawl to be contained within the body of a wrench for sliding contact and reversal of wrenching direction and ratchet action.

A further object of this invention is to provide for containment and reaction of forces by the pawl against the main frame of the wrench body.

Another object of the invention is to provide a solid flat bar for reaction of the wrenching force directly through said pawl.

Another object of the invention is to provide for pawl engagement with a sliding bar to reverse direction of wrenchability and provide ratcheting of a wrench.

A further object is to provide for detenting of the sliding action of a flat bar to determine the location for direction of wrenchability.

A further object of the invention is to provide for containment of the ratchet pawl device within the body of the wrench remote from the working end of the wrench to provide for a thin wall at the end of the wrench that contains the ratchet wheel which actuates the wrenching motion.

A further object of the invention is to provide a high strength ratcheting device that may be used in mechanical apparatus to provide interrupted motion at high mechanical advantage.

The above and other features of this invention will be fully understood from the following detailed description the the accompanying drawings, in which:

DESCRIPTION OF THE INVENTION

Figure 1:
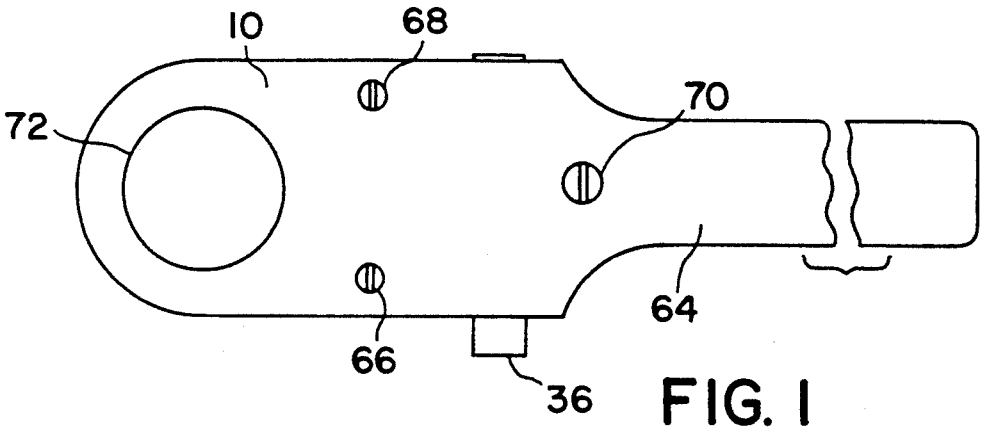
FIG. 1 is a top plan view of a preferred embodiment of the invention.
Figure 2:
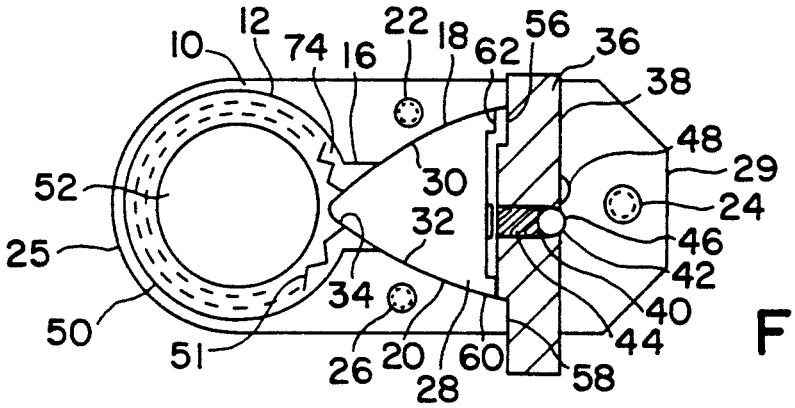
FIG. 2 is a view taken on line 2—2 of FIG. 3.
Figure 3:
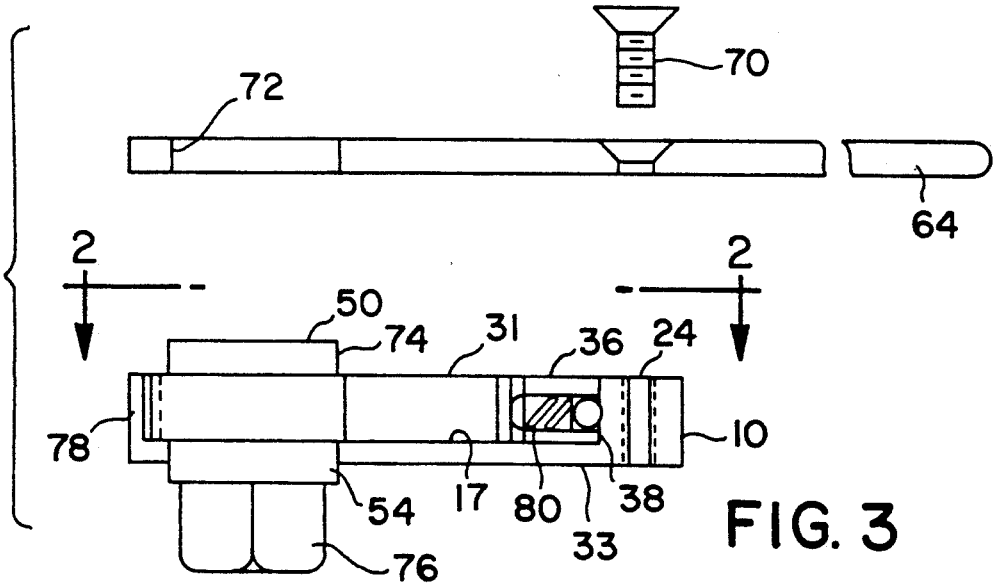
FIG. 3 is an exploded side view of partially in cross-section the preferred embodiment of the invention shown in FIG. 1.

A preferred embodiment of the invention is shown in FIGS. 1, 2 and 3. The frame of the wrench as seen in FIG. 2 and FIG. 3 has a cylindrical bore 12 extending partially through the frame 10 to form a surface 14. A passage 16, formed partially in depth through the frame, forms a surface 17 co-planar with surface 14. This surface 14 is further extended by the formation of arcuate walls 18 and 20 in frame member 10. The frame member 10 has tapped holes 22, 24, and 26 which are adapted to receive screws 66, 68 and 70 for assembly of a handle member 64. A cam member 28 is formed with arcuate surfaces 30 and 32 which closely match the arcuate surfaces 18 and 20 in the frame member 10. A pawl configuration 34 is formed at the apex of the pawl member 28. A slidable bar 36 is engaged within a closely fitting passage 38 in the frame member 10. Centrally located in the sliding bar 36 is a bore 40 containing a detent ball 42 and a biasing spring 44. Detent recesses 46 and 48 position the sliding bar 36. A ratchet wheel 50 engages the pawl 34. The ratchet wheel 50 is formed on a wrenching member 52 which is mounted to the frame 10 by shoulder 54 which can be seen in FIG. 3. Sliding bar 36 has clearances 56 and 58 to permit contact or relief from contact with pads 60 and 62 on the pawl 28.

The handle member 64 is mounted to frame 10 by screws 66, 68 and 70 to provide wrenching force and to contain the assembly of all components within the frame 10.

The bore 72 through the handle 64 retains journal 74 on wrenching member 52 for rotation in the wrench frame. A protruding wrenching shape 76 transmits the wrenching force of the ratchet wheel 50 of this embodiment of this invention.

In operation, the assembly of FIG. 2 shows the interrelation of the working parts of this embodiment of the invention. The ratchet wheel 50 engages the pawl 34 with its obtuse angled teeth 51. The pad 60 on the pawl 28 contacts the surface of sliding bar 36 to transmit force from the ratchet teeth through the pawl 28 and the bar 36 to react with the frame 10. The pad 62 is free to move down against the spring bias when the motion of the handle is reversed to counter clockwise motion to free the pawl 34 from engagement with the ratchet teeth 51. When the sliding bar 36 is moved so that the detent 42 is in its alternate position in the pocket 48 on the frame 10 then the pad 60 is free to deflect into clearance 58 and the ratchet motion is reversed.

Since the mechanism for the pawl is contained within the frame in a location central and remote from the working end of the wrench frame 10, the wall 78 does not carry any mechanical load from the wrenching work and so the resulting wall 78 can be very thin. This construction results in a wrench that can be used in very close quarters to a wall or surface on the workpiece that carries the element to be wrenched, such as a nut or bolt.

As an alternative embodiment of this invention the ratchet wheel may be made in the form of a rack or flat surface with a linear row of ratchet teeth to be engaged by the pawl in a manner that will advance the rack with the wrenching motion, and a bar for stop position, to provide a high strength jacking motion.

This invention is not to be limited by the embodiments shown in the drawings and described in the description, which are given by way of example and not of limitation, but only in accordance with the scope of the appended claims.

I claim:

1. A ratchet device with swivelly contained pawl means which comprises:

a frame member, said frame member including arcuate sidewalls which partially define a chamber means, a ratchet wheel, said ratchet wheel having an axis of rotation, said ratchet wheel secured journally for rotation within said chamber means;

a pawl member, said pawl member having arcuate sides joining to form an angular protruding point adapted to engage said ratchet wheel, said arcuate sides being joined by a surface having protruding pads at each end said pawl member being adapted to engage said ratchet wheel within said chamber means, and said pawl member engaging, said ratchet wheel forces within said chamber means, said side walls being adapted to closely engage said pawl member for swivel motion of said pawl member.

2. A device as described in claim 1 which includes detent means said detent means adapted to restrain said sliding bar means at recesses in said frame member, said recesses adapted to position said sliding bar means with said pawl member to transmit said ratchet forces for rotation of said ratchet wheel.

3. A device as described in claim 1 which includes handle means, said handle means adapted to be mounted to said frame means, said handle means provided with bearing means for swivelly retaining said ratchet wheel, said handle means adapted to retain said pawl member and said sliding bar means within said frame means, said handle means adapted to actuate said ratchet wrench.

4. A device as described in claim 1 which includes wrenching means, said wrenching means formed on said ratchet wheel, said wrenching means having an axis of rotation, said axis of rotation coincident with said axis of rotation of said ratchet wheel.

5. A device as described in claim 2 which includes wrenching means, said wrenching means formed on said ratchet wheel, said wrenching means having an axis of rotation, said axis of rotation coincident with said axis of rotation of said ratchet wheel.

* * * * *